US008105530B2

(12) United States Patent
Cai

(10) Patent No.: US 8,105,530 B2
(45) Date of Patent: Jan. 31, 2012

(54) REINFORCED ALUMINUM ALLOY WITH HIGH ELECTRICAL AND THERMAL CONDUCTIVITY AND ITS MANUFACTURING PROCESS THEREOF

(76) Inventor: Zhou Cai, Guangdong (CN)

( * ) Notice: Subject to any disclaimer, the term of this patent is extended or adjusted under 35 U.S.C. 154(b) by 672 days.

(21) Appl. No.: 12/286,302

(22) Filed: Sep. 29, 2008

(65) Prior Publication Data

US 2009/0087341 A1 Apr. 2, 2009

(30) Foreign Application Priority Data

Sep. 29, 2007 (CN) ..... 2007 1 0175468

(51) Int. Cl.

| | |
|---|---|
| ***C22F 1/04*** | (2006.01) |
| ***C22C 21/06*** | (2006.01) |
| ***C22C 21/04*** | (2006.01) |
| ***C22C 21/08*** | (2006.01) |

(52) U.S. Cl. ..... 420/549; 148/550; 148/688; 148/440; 420/544; 420/546

(58) Field of Classification Search ..... 148/549, 148/550, 688, 440; 420/544, 546
See application file for complete search history.

(56) References Cited

FOREIGN PATENT DOCUMENTS

CN 1667148 A * 9/2005

OTHER PUBLICATIONS

Liu Z et al., English abstract of CN 1667148 A, Sep. 2005, whole document.*

* cited by examiner

*Primary Examiner* — Roy King
*Assistant Examiner* — Caitlin Kiechle
(74) *Attorney, Agent, or Firm* — Raymond Y. Chan; David and Raymond Patent Firm

(57) ABSTRACT

A reinforced aluminum alloy with high electric and thermal conductivity of the present invention has the weight percentage below: Mg 0.61~0.65%, Si 0.4~0.45%, rare earth elements 0.21~0.3%, B 0.03~0.10% and the balances essentially Al and unavoidable impurities. The reinforced aluminum alloy enhanced the containing of Mg and Si elements compared to the conventional aluminum alloy such as 6063, and controlled the containing of the Mg and Si in a certain relatively narrower range so as to control the desired quality of the aluminum alloy. At the same time, a Ce of the rare earth elements and B element are added into the aluminum alloy and completely solid melted the added alloys to the aluminum alloy. It is not only remaining the strength of the aluminum alloy, but also increasing the electric and thermal conductivity.

14 Claims, No Drawings

REINFORCED ALUMINUM ALLOY WITH HIGH ELECTRICAL AND THERMAL CONDUCTIVITY AND ITS MANUFACTURING PROCESS THEREOF

BACKGROUND OF THE PRESENT INVENTION

1. Field of Invention

The present invention relates to an aluminum alloy material, and more particularly to a reinforcing aluminum alloy with high electrical and heat conduction, which is one of the nonferrous metals.

2. Description of Related Arts

These days, most of the CPU, VGA heat dissipation plate of computer and heat transfer devices of communication machine use 6063/T5 aluminum alloy material, wherein the main composition thereof are Mg 0.49~0.9%, Si 0.2~0.6%. The aluminum alloy has the tensile strength ≧160 MP, the yield strength ≧110 MPa, the percentage elongation δ≧8%, the electrical conductivity between 51.5 and 55%, and the heat conductivity 202 w/m·k. The drawbacks of the 6063 aluminum alloy are lacking control the amount of impurities, and the composition ranges of Mg, Si are too broad to control the stability. Therefore, the electric and heat conductivity of 6063/T5 aluminum alloy have to be improved.

As the development of computer, the demand for heat dissipating ability of CPU has not been satisfactory at the present. There is a great need of a higher electric and heat conductivity material to replace the conventional 6063/T5 alloy.

SUMMARY OF THE PRESENT INVENTION

A main object of the present invention is to provide a reinforced aluminum alloy with high electric and heat conduction qualities.

Another object of the present invention is to provide a method for producing the reinforced aluminum alloy with high electric and heat conduction qualities.

Another object of the present invention is to provide a reinforced aluminum alloy with high electric and heat conduction qualities, so that the aluminum alloy is applied on the material of heat dissipation plate.

Accordingly, in order to accomplish the above objects, the present invention of the aluminum alloy essentially has the weight percentage below: Magnesium (Mg) 0.61~0.65%, Silicon (Si) 0.4~0.45%, rare earth elements 0.21~0.3%, Boron (B) 0.03~0.10%, and the rest are Al and unavoidable impurities.

Wherein, the Ce (Cerium) and La (Lanthanum) are two main elements of the rare earth elements of the aluminum alloy of the present invention.

Wherein, the aluminum alloy further has Manganese (Mn)≦0.03%, Ferrum (Fe)≦0.12%, Vanadium (V)≦0.03%, Chromium (Cr)≦0.03%, Titanium (Ti)≦0.03%, and Zirconium (Zr)≦0.03%.

Other impurities are controlled under 0.05% per impurity, totally under 0.15% for all impurities in the aluminum alloy.

Overall, most of the impurities in the aluminum alloy will decrease the mechanical qualities of aluminum alloy, so that the impurities in the alloy should be reduced to a minimum amount.

Accordingly, the present invention provides a process of manufacturing the reinforced aluminum alloy with high electric and heat conductivity, comprising the following steps (the percentage mentioned below are weight percentage).

(1) Casting:

Add 3~3.5%, by weight, of Al—Si alloy, with 95~97%, by weight of aluminum (Al). Then melt the Al—Si alloy with Al metal at a temperature with a range between 700° C. and 800° C. Add 1.9~3.3% by weight of Al-Rare Earth Elements alloy and 0.03~0.10% of Boron (B). Then add 0.63~0.68% by weight of Mg, and then add 1.5~2% by weight of refiner under the temperature between 720 and 740° C. with a refining time between 15 and 20 minutes. Further, place the above raw materials at the temperature between 680° C. and 710° C. for 13~15 minutes, then start casting.

(2) Dispersing:

And then keep the temperature of the raw materials from step (1) at the temperature 560~580° C. for 3.5~4.5 Hr. Further, cool down the raw materials at a cooling rate of 180~220° C./Hr.

Accordingly, the Al—Si alloy has a weight percentage 12~14% of Si element.

Accordingly, the Al-Rare Earth Elements (Re) has a weight percentage 9~11% of Re.

The refiner is preferably Al—Ti—C or Al—Ti—B to ensure the homogenous structure of the aluminum alloy.

The above refining process uses liquefied nitrogen or 99.99% nitrogen gas mixing with a refining agent to refine, wherein the refining agent is consisted of 40% Cryolite ($Na_3AlF_6$), 30% NaCl, and 30% KCl.

The reinforced aluminum alloy with high electric and heat conduction produced by the above manufacturing process can be used for making the heat dissipation plate or heat dissipation devices of the computer CPU, VGA or communication switch as an original material.

Furthermore, the manufacturing process of the heat dissipation plate or device manufactured from the reinforced aluminum alloy from above processing:

(1) Extruding Process:

Heat the aluminum alloy, a die, and a container. The aluminum alloy is heated until its temperature reaches at 480~530° C. The die is heated until its temperature reaches at 460~510° C. The container is heated until its temperature reaches at 450~470° C. An air cooling rate is set at 150~200° C./min to cool down at 50~120° C.

(2) Aging Process:

In the end, keep the temperature of the heat dissipation plates or devices made of the aluminum alloy at 180~200° C. for 2~3 hours.

The heat dissipation plates or devices of the present invention can be manufactured under the stander procedure of conventional heat dissipation plates or devices.

The reinforced aluminum alloy with high electric and heat conduction of present invention, the aluminum alloy material not only has the high strength quality, but also has high electric and heat conduction properties, so that the aluminum alloy material can enhance the heat dissipation ability such as CPU heat dissipation plate to transfer the heat generated inside a device such as computer more efficiency. The aluminum alloy of the present invention has the following advantages:

1. Compare the aluminum alloy material of the present invention to the conventional aluminum alloy 6063, the aluminum alloy of the present invention has narrower control range and richer containing of Mg and Si elements, which are the main elements to strengthen the structure, than the 6063, so that the aluminum alloy providing a higher strength than 6063.

2. Add Ce-based mixed rare earth alloy element to improve the structure of the material, so that eliminates or reduces the impurities elements such as Fe, Si, $Al_2O_3$, $H_2$.

3. Add alloy element B to eliminate or reduce the trace elements, such as V, Zr, Ti, effects on the material electric and thermal conductivity properties, so as to increase the electric and thermal conductivity of the aluminum alloy.

4. Use the high temperature extruding and strong air cooling, so that the strengthening phase of the material, $Mg_2Si$, is solid melted into the aluminum alloy of the present invention.

5. The aluminum alloy of the present invention has gradually increased the mechanical Properties compared to conventional material such as 6063, and increases the electric and thermal conductivity properties about 12%.

These and other objectives, features, and advantages of the present invention will become apparent from the following detailed description, the accompanying drawings, and the appended claims.

DETAILED DESCRIPTION OF THE PREFERRED EMBODIMENT

A process of manufacturing a reinforced aluminum alloy with high electric and thermal conductivity, according to a first preferred embodiment of the present invention comprises the following steps.

(1) Casting:

Add 3.2 Kg of Al—Si alloy (Si is 13%, by weight) and 95.0 Kg of Aluminum (Al), then heat the above mixture material to 770° C., and then add 2.6 Kg Al-Rare Earth Elements (Al—Re) alloy, which has 10% of Re by weight, 0.04 Kg of Boron (B), and 0.67 Kg of Magnesium (Mg). Further, add 1.8 Kg of refiner into the above mixture at 740° C. to refine for 15 minutes, and then stand the mixture at 700° C. for another 16 minutes for further casting. Nitrogen gas and a refining agent are added for the mixture refining process to refine, wherein the refining agent contains 40% Cryolite ($Na_3AlF_6$), 30% NaCl, and 30% KCl.

(2) Dispersing:

Keep the temperature of the raw materials from Casting step at the temperature 570° C. for 4 hours. Further, cool down the raw materials in a cooling rate of 197° C./Hr for 10 minutes by water mist.

Thus, we can get an original material of reinforced aluminum alloy with high electric and thermal conductivity, wherein the original material of reinforced aluminum alloy contains the weight percentages below: 0.61% of Mg, 0.41% of Si, 0.11% of Fe, 0.14% of Ce, 0.07% of La (lanthanum), 0.04% of B, 0.012% of V, 0.016% of Mn, 0.015% of Cr, 0.02% of Ti, 0.026% of Zr, and the rest is Al.

The original material of aluminum alloy with high electric and thermal conductivity of the present invention according to the first preferred embodiment has the following properties. The tensile strength (δb) is 172 MP, the yield strength (δ0.2) is 113 MPa, the percentage elongation rate (δ) is 8.2%, and the electrical conductivity is 59% IACS. Accordingly, the tests of the tensile strength, yield strength, and the elongation rate are on the "GB/T228-2002 metal material tensile test method at room temperature". The test of the electrical conductivity is based on "Electrical conductivity vortex test of YS/T478-200 Copper and Copper alloy". Thus, the aluminum alloy has the high electrical conductivity so as to have a high thermal conductivity due to the carrier of the thermal conduction is an electron of metal. According to the Wiedemann-Franz law, that states the ratio of the thermal conductivity (λ) to the electrical conductivity (σ) of a metal is proportional to the temperature (T): $\lambda/\sigma T=L$, wherein the L is the proportionality constant L, known as the Lorenz number, wherein the constant L for Al is $2.2\times10^{-8}$ W·Ω/K, wherein K is equal to 293K under room temperature, so that the thermal conductivity (λ) is 220 w/m·k.

Accordingly, the reinforced aluminum alloy is further manufactured to produce a heat dissipation plate or device, comprising the steps of:

(1) Extruding Process:

Heat the original material of aluminum alloy to 520° C., a die to 500° C., and a container to 480° C. Cool to 65° C. with an air cooling rate 150° C./min.

(2) Aging Process:

In the end, keep the temperature of the heat dissipation plates or devices made from the aluminum alloy at 180° C. for 3 hours.

A method of manufacturing a reinforced aluminum alloy with high electric and thermal conductivity, according to a second preferred embodiment of the present invention comprises the following steps:

(1) Casting:

Add 3.5 Kg of Al—Si alloy (Si is 14%, by weight) and 97.0 Kg of Aluminum (Al), then heat the above mixture material to 700° C., and then add 1.9 Kg of Al-Rare Earth Elements (Al—Re) alloy, which has 11% Re by weight, 0.07 Kg B element, and 0.68 Kg Mg element. Further, add 1.5 Kg of refiner, Al—Ti—B, into the above mixture at 720° C. to refine for 18 minutes, and then stand the mixture at 710° C. for another 13 minutes for further casting.

(2) Dispersing:

Keep the temperature of the raw materials from Casting step at the temperature 560° C. for 4.5 hours. Further, cool down the raw materials with a mist cooling rate 180° C./Hr for 15 minutes.

Thus, we can get an original material of reinforced aluminum alloy with high electric and thermal conductivity, wherein the original material of reinforced aluminum alloy contains the weight percentages below: 0.65% of Mg, 0.45% of Si, 0.21% of Ce, 0.08% of La, 0.07% of B, 0.012% of V, 0.016% of Mn, 0.015% of Cr, 0.013% of Ti, 0.02% of Zr, and the rest is Al.

The original material of aluminum alloy with high electric and thermal conductivity of the present invention according to the second preferred embodiment has the following properties. The tensile strength (δb) is 174 MP, the yield strength (δ0.2) 115 MPa, the percentage elongation rate (δ) is 8.0%, and the electrical conductivity is 58.8% IACS. The tests of the aluminum alloy are mentioned above as the first embodiment.

Accordingly, the reinforced aluminum alloy is further manufactured to produce a heat dissipation plate or device, comprising the steps of:

(1) Extruding Process:

Heat the original material of aluminum alloy to 530° C., a die to 510° C., and a container to 450° C. Cool to 120° C. with an air cooling rate 180° C./min.

(2) Aging Process:

In the end, keep the temperature of the heat dissipation plates or devices made from the aluminum alloy at 200° C. for 2.5 hours.

A method of manufacturing a reinforced aluminum alloy with high electric and thermal conductivity, according to a third preferred embodiment of the present invention comprises the following steps:

(1) Casting:

Add 3.0 Kg of Al—Si alloy (Si is 12%, by weight) and 96.0 Kg of Aluminum (Al), then heat the above mixture material to 800° C., and then add 3.3 Kg of Al-Rare Earth Elements (Al—Re) alloy, which has 9% Re, by weight, 0.06 Kg of B element, and 0.63 Kg of Mg element. Further, add 2.0 Kg of refiner, Al—Ti—C, into the above mixture at 730° C. to refine for 20 minutes, and then stand the mixture at 680° C. for another 18 minutes for further casting.

(2) Dispersing:

Keep the temperature of the raw materials from Casting step at the temperature 580° C. for 3.5 hours. Further, cool down the raw materials in a cooling rate 220° C./Hr for 8 minutes.

Thus, we can get an original material of reinforced aluminum alloy with high electric and thermal conductivity, wherein the original material of reinforced aluminum alloy contains the weight percentages below: 0.63% of Mg, 0.4% of Si, 0.18% of Ce, 0.07% of La, 0.06% of B, 0.011% of V, 0.015% of Mn, 0.013% of Cr, 0.012% of Ti, 0.018% of Zr, and the rest is Al.

The original material of aluminum alloy with high electric and thermal conductivity of the present invention according to the third preferred embodiment has the following properties: the tensile strength (δb) is 173 MP, the yield strength (δ0.2) 112 MPa, the percentage elongation rate (δ) is 8.2%, and the electrical conductivity is 59.2% IACS. The tests of the aluminum alloy are mentioned above as the first embodiment.

Accordingly, the reinforced the aluminum alloy is further manufactured to produce a heat dissipation plate or device, comprising the steps of:

(1) Extruding Process:

Heat the original material of aluminum alloy to 480° C., a die to 460° C., and a container to 470° C. Cool to 50° C. with an air cooling rate 200° C./min.

(2) Aging Process:

In the end, keep the temperature of the heat dissipation plates or devices made from the aluminum alloy at 180° C. for 2 hours.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A process of manufacturing a reinforced aluminum alloy, comprising a casting step and a dispersing step, wherein said casting step comprises the steps of:

(a) add 3~3.5% by weight of Al—Si alloy, with 95~97% by weight of aluminum (Al);

(b) melting said Al—Si alloy with said aluminum at a temperature with a range between 700° C. and 800° C.;

(c) adding 1.9~3.3% by weight of Al-Rare Earth Elements and 0.03~0.10% of Boron (B) with said melted Al—Si alloy and aluminum;

(d) adding 0.63~0.68% by weight of Magnesium (Mg), (e) adding 1.5~2% by weight of refiner under a temperature between 720 and 740° C. with a refining time between 15 and 20 minutes to proceed a refining process; and (f) placing said materials at a temperature between 680° C. and 710° C. for 13 to 15 minutes;

wherein said dispersing step comprises the step of:

(g) keeping a temperature of said materials from said casting step at a temperature between 560 and 580° C. for 3.5 to 4.5 Hr;

(h) cooling down said materials at a cooling rate of 180~220° C./Hr to form said reinforced aluminum alloy.

2. The process, as recited in claim 1, wherein said Al—Si alloy has 12 to 14% of Si element by weight.

3. The process, as recited in claim 1, wherein Al-Rare Earth Elements has a 9 to 11% of Re by weight.

4. The process, as recited in claim 2, wherein Al-Rare Earth Elements has a 9 to 11% of Re by weight.

5. The process, as recited in claim 1, wherein said reinforced aluminum alloy has essentially 0.61 to 0.65% of Magnesium (Mg) by weight, 0.4 to 0.45% of Silicon (Si) by weight, 0.21 to 0.3% of rare earth element by weight, 0.03 to 0.10% of Boron (B) by weight, and the rest are Aluminum (Al) and unavoidable impurities.

6. The process, as recited in claim 4, wherein said reinforced aluminum alloy has essentially 0.61 to 0.65% of Magnesium (Mg) by weight, 0.4 to 0.45% of Silicon (Si) by weight, 0.21 to 0.3% of rare earth element by weight, 0.03 to 0.10% of Boron (B) by weight, and the rest are Aluminum (Al) and unavoidable impurities.

7. The process, as recited in claim 5, wherein said rare earth element comprises Cerium (Ce) and Lanthanum (La) as major elements, wherein said reinforced aluminum alloy further has elements of Manganese (Mn), Ferrum (Fe) Vanadium (V), Chromium (Cr), Titanium (Ti), and Zirconium (Zr), wherein ratio of said elements are Mn≦0.03% by weight, Fe≦0.12% by weight, V≦0.03% by weight, Cr≦0.03% by weight, Ti≦0.03% by weight, and Zr≦0.03% by weight.

8. The process, as recited in claim 6, wherein said rare earth element comprises Cerium (Ce) and Lanthanum (La) as major elements, wherein said reinforced aluminum alloy further has elements of Manganese (Mn), Ferrum (Fe) Vanadium (V), Chromium (Cr), Titanium (Ti), and Zirconium (Zr), wherein ratio of said elements are Mn≦0.03% by weight, Fe≦0.12% by weight, V≦0.03% by weight, Cr≦0.03% by weight, Ti≦0.03% by weight, and Zr≦0.03% by weight.

9. The process, as recited in claim 1, wherein said refiner is one of Al—Ti—C and Al—Ti—B for ensuring a homogenous structure of said reinforced aluminum alloy.

10. The method, as recited in claim 9, wherein said rare earth element comprises Cerium (Ce) and Lanthanum (La) as major elements, wherein said reinforced aluminum alloy further has elements of Manganese (Mn), Ferrum (Fe) Vanadium (V), Chromium (Cr), Titanium (Ti), and Zirconium (Zr), wherein ratio of said elements are Mn≦0.03% by weight, Fe≦0.12% by weight, V≦0.03% by weight, Cr≦0.03% by weight, Ti≦0.03% by weight, and Zr≦0.03% by weight.

11. The process, as recited in claim 8, wherein said refiner is one of Al—Ti—C and Al—Ti—B for ensuring a homogenous structure of said reinforced aluminum alloy.

12. The process as recited in claim 1 wherein, in the step (e), one of liquefied nitrogen and 99.99% nitrogen gas is mixed with a refining agent in said refining process, wherein said refining agent is consisted of 40% Cryolite ($Na_3AlF_6$), 30% NaCl, and 30% KCl.

13. The process as recited in claim 11 wherein, in the step (e), one of liquefied nitrogen and 99.99% nitrogen gas is mixed with a refining agent in said refining process, wherein said refining agent is consisted of 40% Cryolite ($Na_3AlF_6$), 30% NaCl, and 30% KCl.

14. A method of manufacturing heat dissipation device made of reinforced aluminum alloy, comprising the steps of extruding step and an aging step, wherein said extruding step comprises the steps of heating said reinforced aluminum alloy at 480~530° C., a die at 460~510° C., and a container 450~470° C., and cooling down said reinforced aluminum alloy at an air cooling rate at 150~200° C./min and a temperature at 50~120° C., wherein said aging step comprises a step of keeping a temperature of said heat dissipation device made of said reinforced aluminum alloy at 180~200° C. for 2~3 hours, wherein reinforced aluminum alloy has essentially 0.61 to 0.65% of Magnesium (Mg) by weight, 0.4 to 0.45% of Silicon (Si) by weight, 0.21 to 0.3% of rare earth element by weight, 0.03 to 0.10% of Boron (B) by weight, and the rest are Aluminum (Al) and unavoidable impurities, wherein said reinforced aluminum alloy is manufactured by process comprising a casting step and a dispersing step;

wherein said casting step comprises the steps of:

(a) add 3~3.5% by weight of Al—Si alloy, with 95~97% by weight of aluminum (Al);

(b) melting said Al—Si alloy with said aluminum at a temperature with a range between 700° C. and 800° C.;

(c) adding 1.9~3.3% by weight of Al-Rare Earth Elements and 0.03~0.10% of Boron (B) with said melted Al—Si alloy and aluminum;

(d) adding 0.63~0.68% by weight of Magnesium (Mg), (e) adding 1.5~2% by weight of refiner under a temperature between 720 and 740° C. with a refining time between 15 and 20 minutes to proceed a refining process; and (f) placing said materials at a temperature between 680° C. and 710° C. for 13 to 15 minutes;

wherein said dispersing step comprises the step of:

(g) keeping a temperature of said materials from said casting step at a temperature between 560 and 580° C. for 3.5 to 4.5 Hr;

(h) cooling down said materials at a cooling rate of 180~220° C./Hr to form said reinforced aluminum alloy.

* * * * *